US007354225B1

(12) United States Patent
Cohen

(10) Patent No.: US 7,354,225 B1
(45) Date of Patent: Apr. 8, 2008

(54) DECORATIVE PLANT MARKER STAKE

(76) Inventor: Richard Cohen, 2561 Hawthorn, Ann Arbor, MI (US) 48104

( * ) Notice: Subject to any disclaimer, the term of this patent is extended or adjusted under 35 U.S.C. 154(b) by 0 days.

(21) Appl. No.: 11/734,936

(22) Filed: Apr. 13, 2007

(51) Int. Cl.
*G09F 19/00* (2006.01)

(52) U.S. Cl. ..... 405/259.1; 40/645; 47/47

(58) Field of Classification Search ..... 405/259.1; 40/645; 47/47
See application file for complete search history.

(56) References Cited

U.S. PATENT DOCUMENTS

| | | | | | |
|---|---|---|---|---|---|
| 517,545 | A * | 4/1894 | Duckett | 40/659 |
| 551,000 | A * | 12/1895 | Parker | 40/645 |
| 1,590,722 | A * | 6/1926 | Brakmeier | 40/645 |
| 1,616,147 | A * | 2/1927 | Smiley | 40/645 |
| 2,031,394 | A * | 2/1936 | Vander Kraats | 40/645 |
| 2,173,217 | A * | 9/1939 | Thomsen | 47/47 |
| 2,209,873 | A * | 7/1940 | Cross | 40/645 |
| 2,229,527 | A * | 1/1941 | Schouman | 47/47 |
| 2,520,818 | A * | 8/1950 | Terry | 47/41.14 |
| 2,650,454 | A * | 9/1953 | Wurdinger | 47/44 |
| 5,044,200 | A * | 9/1991 | Dailey et al. | 40/645 |
| 6,195,926 | B1 * | 3/2001 | Jarl et al. | 40/645 |

* cited by examiner

*Primary Examiner*—Frederick L. Lagman
(74) *Attorney, Agent, or Firm*—Gifford, Krass, Sprinkle, Anderson & Citkowski, PC

(57) ABSTRACT

A decorative marker which may be used to identify plants in a garden comprises a wire form encircling and capturing a decorative object such that the object can still be viewed through the wire form. A panel for receiving identifying indicia is connected to the wire form, and an elongated ground stake is connected to the wire form or panel, allowing the stake to be planted in the earth with the entrapped object and panel visible above ground. In the preferred embodiment, the decorative object is a glass sphere containing a glow-in-the-dark material such as photoluminescent, fluorescent or phosphorescent pigments or particles. The wire form preferably spirals around the globe.

7 Claims, 1 Drawing Sheet

DECORATIVE PLANT MARKER STAKE

FIELD OF THE INVENTION

This invention relates generally to decorative objects for use in gardens, and the like, and, in particular, to a decorative marker which may be used to identify plants in a garden, for example.

BACKGROUND OF THE INVENTION

Gardening enthusiasts often use small markers to identify plants. These generally include some form of wire or stake that is placed into the ground, with an area that may be written upon as a reminder of what is, or will be, growing in that location. Although numerous garden markers are in existence, some of which have been patented, the need will always remain for unique articles for this intended purpose.

SUMMARY OF THE INVENTION

This invention resides in a decorative marker which may be used to identify plants in a garden, for example. The article broadly comprises a wire form encircling and capturing a decorative object such that the object can still be viewed through the wire form. A panel for receiving identifying indicia is connected to the wire form, and an elongated ground stake is connected to the wire form or panel, allowing the stake to be planted in the earth with the entrapped object and panel visible above ground.

In the preferred embodiment, the decorative object is a glass sphere containing a glow-in-the-dark material such as photoluminescent, fluorescent or phosphorescent pigments or particles. The wire form preferably spirals around the globe. The panel may further comprise a peripheral wire form and a writing surface supported within the peripheral wire form. The writing surface may be a sheet of metal supported within the peripheral wire form, the sheet being sufficiently malleable that the identifying indicia may be applied by scribing the metal with a pointed object. The wire form or forms are preferably a weldable or solderable weather-resistant metal such as copper, bronze, copper-plated steel, or the like.

DETAILED DESCRIPTION OF THE INVENTION

Figure 1:
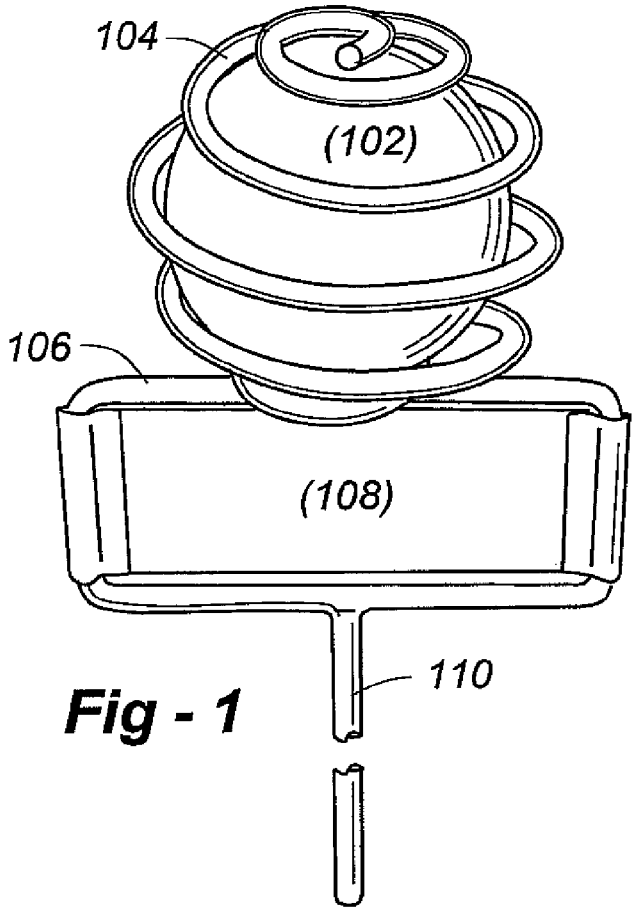
FIG. 1 is a drawing which shows the preferred embodiment of the invention from a front, somewhat oblique view.

Turning now to the drawings, the preferred embodiment of the invention is depicted in FIG. 1. This article includes a wire form 104 which encircles and entraps an object 102. In the preferred embodiment, the object 102 is a glass globe containing glow-in-the-dark material, such as a photoluminescent, fluorescent, or a phosphorescent pigment or articles suspended in the glass. Although in the preferred embodiment the wire form 104 generally spirals around a spherical object 102, this design may be varied, in that other forms of wire "cages" may be used, along with differently shaped objects 102.

Figure 2:
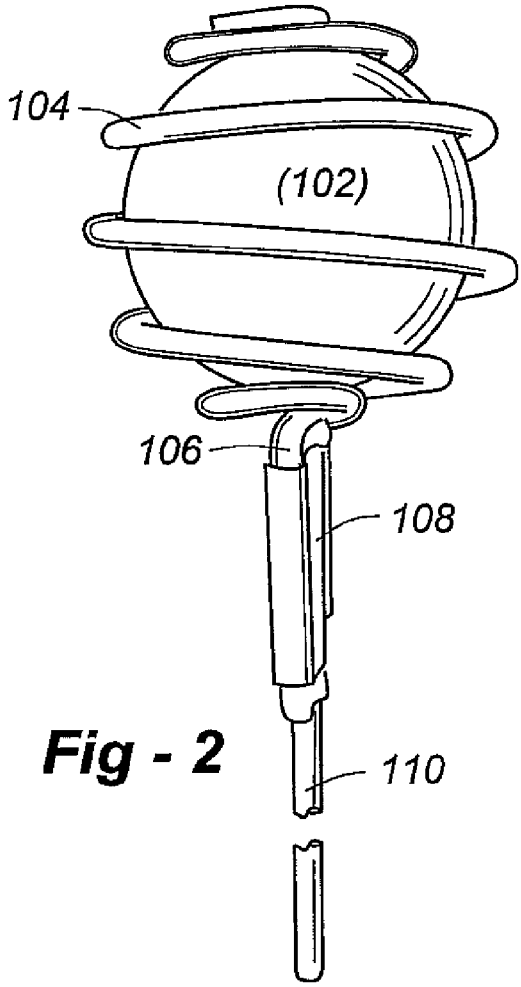
FIG. 2 is a side view of the preferred embodiment.
Figure 3:
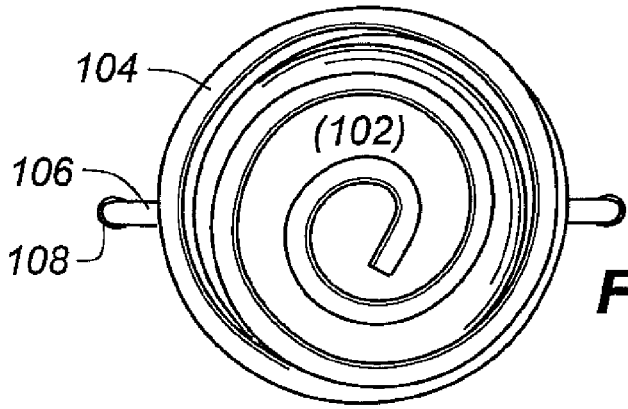
FIG. 3 is a top view of the preferred embodiment.

The bottom of the wire form 104 is attached to a panel 108, used for marking with identifying indicia. In the preferred embodiment, the panel 108 is made of a thin and/or malleable metal, enabling words to be placed with a marker or engraved in the metal with a sharp or pointed object. If the same is metal is used, it may be contained within a peripheral wire form 106, with the edges of the center panel 108 being folded over and glued or soldered, as shown. The bottom of the panel portion is connected to an elongate stake 110, having a length greater than 6 inches, which is shoved into the ground to maintain the article in an upright position proximate to a plant or other object to be identified. FIG. 2 is a side-view drawing with a preferred embodiment, and FIG. 3 is a top-down view.

The wire form 104, and wire form 106 (if present) along with stake 110, are preferably made of a weather-resistant pure or plated metal. Again, although the panel is shown as a thin metal or form 108 suspended within a peripheral frame 106, it will be appreciated that a solid single piece of material may alternatively be used, though this may not permit inscribing. Further, although the panel 108 and frame 106 are shown below the caged object, a panel, with or without a frame, may be attached to the top portion of the caged object, with the stake 110 then extending down from the bottom portion of the caged object directly.

I claim:

1. A garden marker, comprising:

a spherical glass globe;

a wire form spiraling around and capturing the globe such that the globe can still be viewed through the wire form;

a panel connected to the wire form for receiving identifying indicia; and an elongated ground stake connected to the wire form or panel.

2. The garden marker of claim 1, wherein the glass globe contains a glow-in-the-dark material.

3. The garden marker of claim 1, wherein the glass globe contains a photoluminescent, fluorescent or phosphorescent material.

4. The garden marker of claim 1, wherein the panel is generally rectangular.

5. The garden marker of claim 1, wherein the panel further comprises:

a peripheral wire form; and a writing surface supported within the peripheral wire form.

6. The garden marker of claim 1, wherein the panel further comprises:

a peripheral wire form; and a sheet of metal supported within the peripheral wire form, the sheet being sufficiently malleable that the identifying indicia may be applied by scribing the metal with a pointed object.

7. The garden marker of claim 1, wherein the wire form is made with copper or an alloy thereof.

* * * * *